US007833107B1

(12) United States Patent
Garcia-Morales

(10) Patent No.: US 7,833,107 B1
(45) Date of Patent: Nov. 16, 2010

(54) APPARATUS TO AID IN DIVING TECHNIQUES INTO A BODY OF WATER

(76) Inventor: Ramon A. Garcia-Morales, 12663 NW. 8 Way, Miami, FL (US) 33183

( * ) Notice: Subject to any disclaimer, the term of this patent is extended or adjusted under 35 U.S.C. 154(b) by 303 days.

(21) Appl. No.: 12/098,520

(22) Filed: Apr. 7, 2008

(51) Int. Cl.
*A63G 21/00* (2006.01)
*A63B 5/08* (2006.01)
*A63B 69/10* (2006.01)

(52) U.S. Cl. ..... 472/116; 482/30; 434/254

(58) Field of Classification Search ..... 472/116, 472/128; 4/496, 488; 482/30; 434/254
See application file for complete search history.

(56) References Cited

U.S. PATENT DOCUMENTS 74,131 A * 2/1868 Priest ..... 298/17 R
2,886,315 A * 5/1959 Marshall ..... 434/247
3,112,928 A * 12/1963 Oswald ..... 482/55
3,409,294 A * 11/1968 Brosse ..... 434/247
5,466,156 A * 11/1995 Ramirez ..... 434/247

* cited by examiner

*Primary Examiner*—Gene Kim
*Assistant Examiner*—Michael D Dennis
(74) *Attorney, Agent, or Firm*—Albert Bordas, P.A.

(57) ABSTRACT

An apparatus to aid in diving techniques, comprising a base assembly having first and second frame arms and first and second transversal supports. The first and second frame arms are perpendicularly disposed to the first and second transversal supports. The first transversal support comprises a first L-bracket and the second transversal support comprises a second L-bracket. A slide assembly comprises first and second lateral sides and first and second ends. The slide assembly is hingedly mounted onto the base assembly by at least one hinge. Elevation means elevate the first end to place the slide assembly from an approximately horizontal position to an angled position.

18 Claims, 3 Drawing Sheets

APPARATUS TO AID IN DIVING TECHNIQUES INTO A BODY OF WATER

BACKGROUND OF THE INVENTION

1. Field of the Invention

The present invention relates to diving platforms, and more particularly, to an apparatus to aid divers with head-entry diving techniques into a body of water.

2. Description of the Related Art

It is often said that swimming races are won or lost at the start. If a swimmer has a poor start, the swimmer is forced to play catch-up, which is a great disadvantage. A poor start can cost valuable time, and in some cases, the whole race. It is important for swimmers to be taught proper head-entry diving techniques into a body of water. Many diving platforms have been developed in the past. Most of them provide for a number of more or less complicated features that fail to solve the problem in an efficient and economical way. None of them suggest the novel features of the present invention, to aid swimmers with head-entry diving techniques into a body of water.

SUMMARY OF THE INVENTION

The instant invention is an apparatus to aid in diving techniques, comprising a base assembly having first and second frame arms and first and second transversal supports. The first and second frame arms are perpendicularly disposed to the first and second transversal supports. The first transversal support comprises a first L-bracket and the second transversal support comprises a second L-bracket. A slide assembly comprises first and second lateral sides and first and second ends. The slide assembly is hingedly mounted onto the base assembly by at least one hinge. Elevation means elevate the first end to place the slide assembly from an approximately horizontal position to an angled position.

The first L-bracket and the second L-bracket face each other so as to form a U-shape with the first and second frame arms. The first transversal support is fixed onto the first and second frame arms and the second transversal support comprises first and second journaling sleeves to journal the first and second frame arms. The slide assembly further comprises at least one longitudinal frame member having third and fourth ends. The third end of the at least one longitudinal frame member extends a predetermined distance beyond the first end. The fourth end of the at least one longitudinal frame member fits onto a receiving member secured onto the at least one hinge. The slide assembly further comprises a lip angularly extending a predetermined length from the second end without reaching the first end. The slide assembly further comprises at least transversal support member positioned between the first and second lateral sides.

It is therefore one of the main objects of the present invention to provide an apparatus to aid swimmers with head-entry diving techniques.

It is another object of this invention to provide an apparatus to aid in diving techniques to reduce swim race start times.

It is another object of this invention to provide an apparatus to aid in diving techniques that can be mounted onto a swimming pool border or a starting block.

It is another object of this invention to provide an apparatus to aid in diving techniques that is comfortable for swimmers that are intimidated by a body of water, such as a swimming pool.

It is another object of this invention to provide an apparatus to aid in diving techniques that is comfortable for swimmers that are intimidated by swim race starts.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
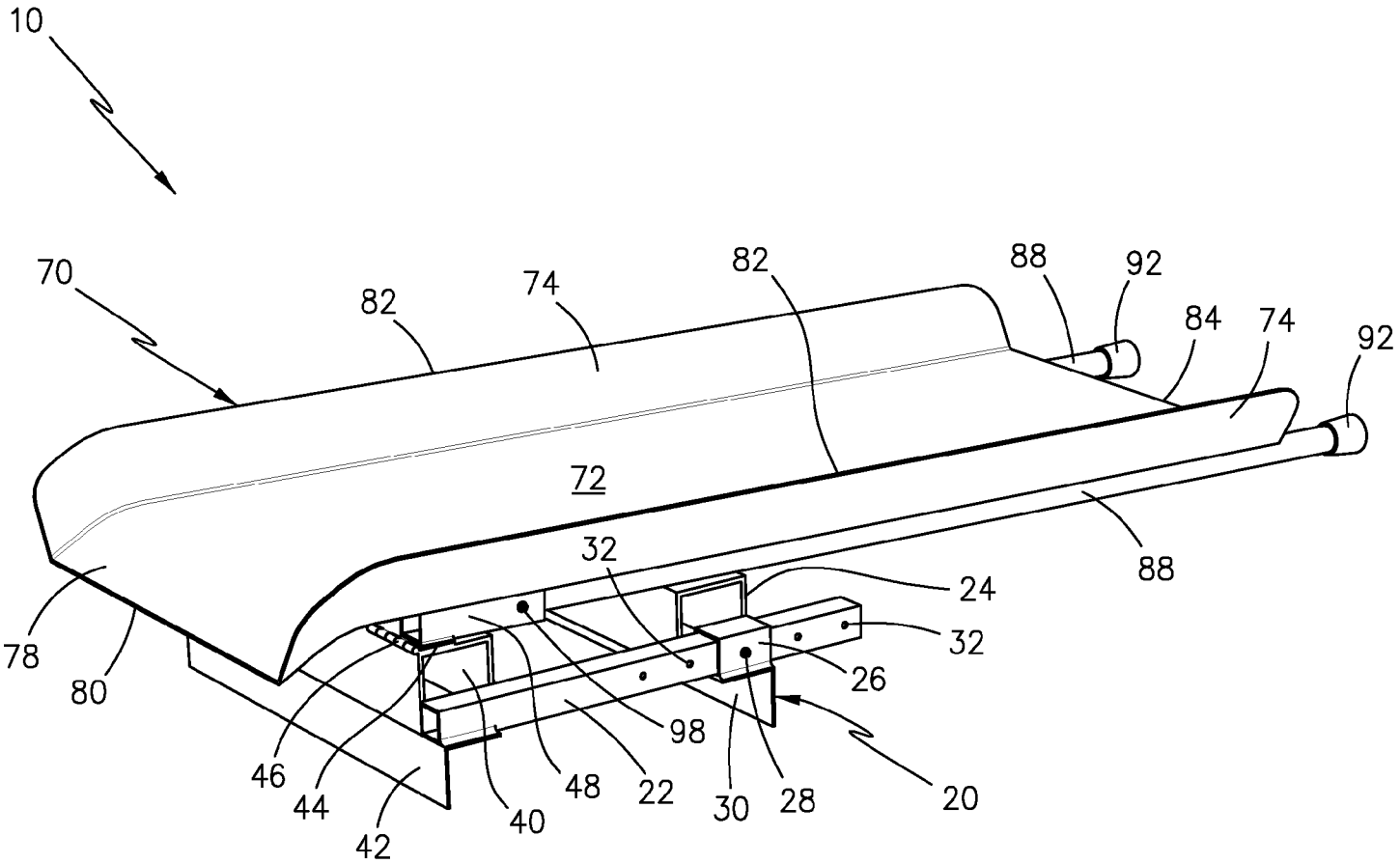
FIG. 1 represents an isometric view of the instant invention.

Referring now to the drawings, the present invention is generally referred to with numeral 10. It can be observed that it basically includes base assembly 20 and slide assembly 70.

Figure 2:
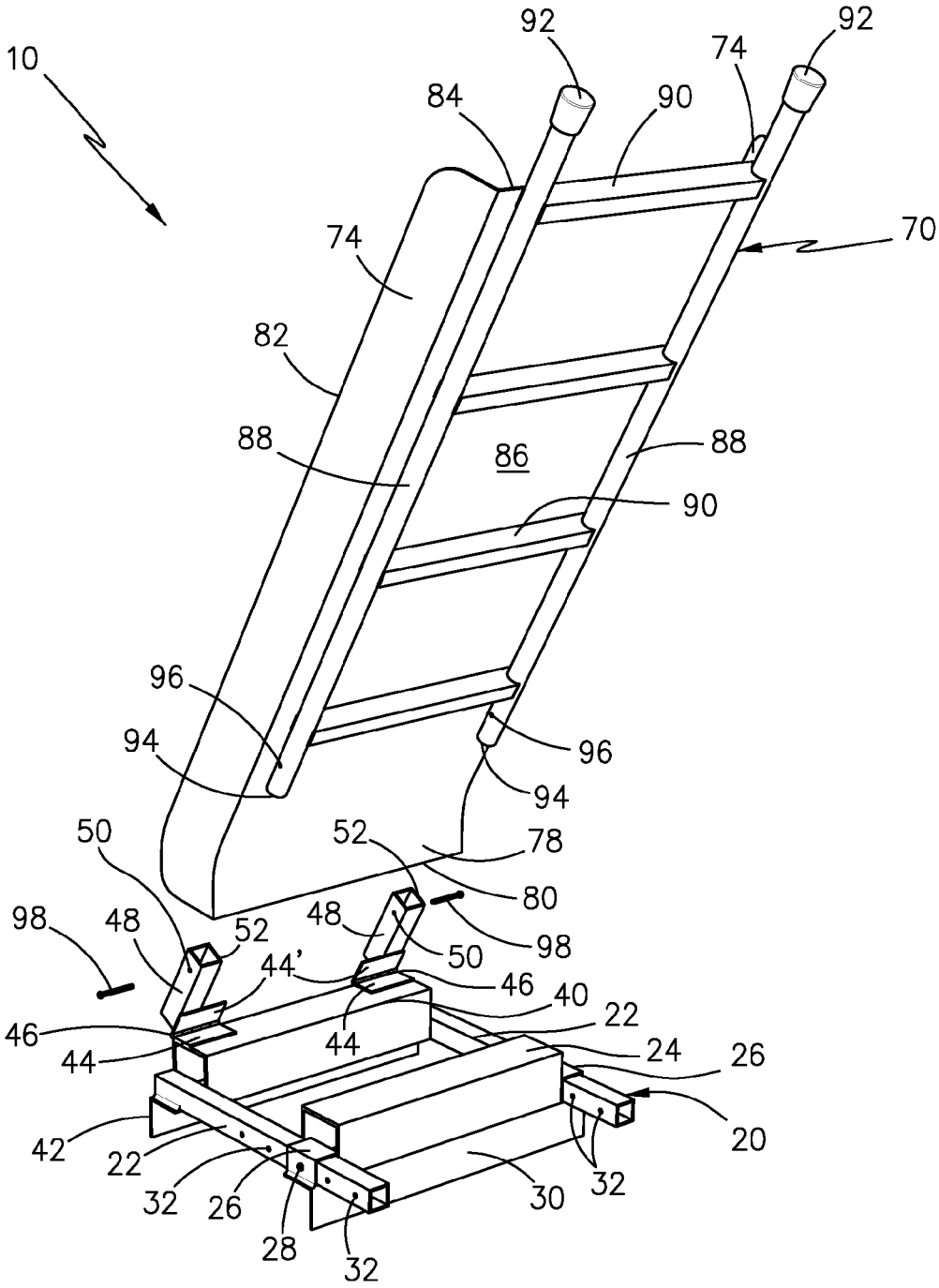
FIG. 2 is a partial exploded isometric view of the instant invention.

As seen in FIGS. 1 and 2, base assembly 20 comprises frame arms 22 that are kept in a parallel and spaced apart relationship with respect to each other by transversal supports 24 and 40. Frame arms 22 each have a plurality of through holes 32 positioned at a predetermined distance from their respective rear ends without reaching their respective front ends. In the preferred embodiment, transversal support 24 is welded to L-bracket 30, and journaling sleeves 26 are also welded to L-bracket 30 adjacent to ends of transversal support 24. Journaling sleeves 26 slidably journal frame arms 22 to selectively determine a desired distance between L-bracket 30 and L-bracket 42. Once the desired distance between L-bracket 30 and L-bracket 42 is defined, journaling sleeves 26 are fixed in position onto frame arms 22 with bolts 28.

In the preferred embodiment, transversal support 40 is welded to L-bracket 42, and front ends of frame arms 22 are also welded to L-bracket 42 adjacent to lateral ends of transversal support 40. It is noted that L-brackets 30 and 42 face each other, so as to form U-shapes with frame arms 22. Hinge tabs 44 are each mounted at a top wall of transversal support 40, next to its transversal ends, and have their respective hinges 46. Hinge tabs 44' are each mounted to receiving members 48, and have their respective said hinges 46. Receiving members 48 have distal ends 52 and transversal through holes 50 that are a predetermined distance from their respective distal end 52.

As best seen in FIG. 1, slide assembly 70 comprises top face 72 having lateral sides 74 perpendicularly extending therefrom. Lateral sides 74 have lateral edges 82. Slide assembly 70 also comprises rear edge 84 and lip 78 that terminates at front edge 80.

As best seen in FIG. 2, bottom face 86 has longitudinal frame members 88 that are kept at a parallel and spaced apart relationship with respect to each other by transversal support members 90. Longitudinal frame members 88 protrude beyond rear edge 84 and have end caps 92 at one end and front ends 94 at their other end. Transversal through holes 96 are at a predetermined distance from respective front ends 94. Slide assembly 70 is mounted to base assembly 20 by inserting front ends 94 into receiving members 48 until through holes 50 and 96 align. Bolts 98 are placed through through holes 50 and 96 to lock slide assembly 70 in place.

Figure 3A:
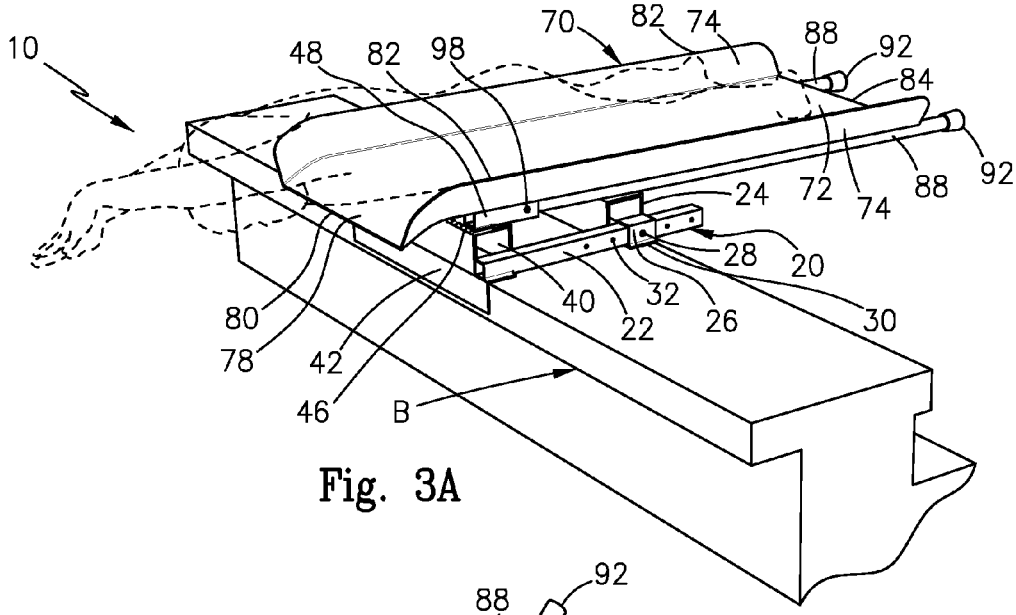
FIG. 3A is a first isometric view of the instant invention in an initial position mounted onto a swimming pool border.

As seen in FIG. 3A, base assembly 20 is mounted to swimming pool border B by adjusting L-bracket 30 to the desire position, according to the dimensions or width of border B. Once the desired position is obtained, bolts 28 lock base assembly firmly in place. Alternatively and in the same way, base assembly 20 may be mounted onto a swimming pool starting block. In the initial position seen in this illustration, slide assembly 70 is in a horizontal position. In the preferred embodiment, a person positions their body facedown as shown, whereby at least the face extends beyond front edge 80. In one head-entry diving technique, the person extends their arms as seen in this illustration, in position for a head-entry dive.

Figure 3B:
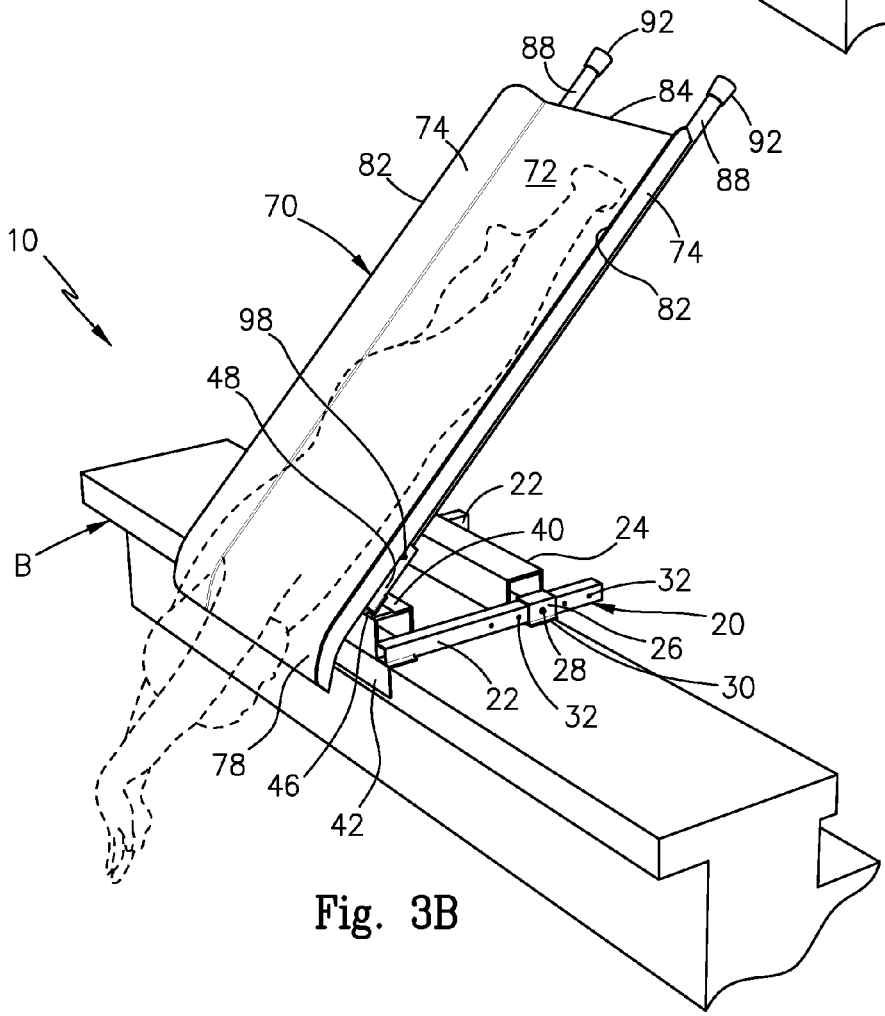
FIG. 3B is a second isometric view of the instant invention in a diving position mounted onto the swimming pool border.

As seen in FIG. 3B, in the diving position, slide assembly 70 defines approximately a 30 to 90 degree angle with respect to frame arms 22. To attain the diving position from the initial position in FIG. 3A, a trainer, assistant, or other person, not seen, elevates slide assembly 70 at the protruding sections of longitudinal frame members 88 next to end caps 92, while the person in position to dive lays thereon, thus defining elevation means. When a sufficient degree angle is reached, the person in position to dive slides downwardly over lip 78 by gravity into a body of water such as a swimming pool. Although not illustrated, base assembly may operate electronically or pneumatically to lift slide assembly 70.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus to aid in diving techniques, comprising:

A) a base assembly comprising first and second frame arms that are kept in a parallel and spaced apart relationship with respect to first and second transversal supports, said first and second frame arms are perpendicularly disposed to said first and second transversal supports, said first and second frame arms each have a plurality of through holes, said first transversal support comprises a first L-bracket and said second transversal support comprises a second L-bracket;

B) a slide assembly comprising a top face having first and second lateral sides extending therefrom and first and second ends, said first and second lateral sides each have lateral edges, said slide assembly further comprising a bottom face having longitudinal frame members that are kept at a spaced apart relationship with respect to each other by third transversal supports, said longitudinal frame members of said slide assembly hingedly mounted onto said base assembly by at least one hinge; and C) elevation means to elevate said first end to place said slide assembly from an approximately horizontal position to an angled position.

2. The apparatus to aid in diving techniques set forth in claim 1, further characterized in that said first and second frame arms are perpendicularly disposed to said first and second transversal supports.

3. The apparatus to aid in diving techniques set forth in claim 1, further characterized in that said first L-bracket and said second L-bracket face each other so as to form a U-shape with said first and second frame arms.

4. The apparatus to aid in diving techniques set forth in claim 1, further characterized in that said first transversal support is fixed onto said first and second frame arms.

5. The apparatus to aid in diving techniques set forth in claim 1, further characterized in that said second transversal support comprises first and second journaling sleeves to journal said first and second frame arms.

6. The apparatus to aid in diving techniques set forth in claim 1, further characterized in that said slide assembly further comprises at least one longitudinal frame member having third and fourth ends.

7. The apparatus to aid in diving techniques set forth in claim 6, further characterized in that said third end of said at least one longitudinal frame member extends a predetermined distance beyond said first end.

8. The apparatus to aid in diving techniques set forth in claim 6, further characterized in that said fourth end of said at least one longitudinal frame member fits onto a receiving member secured onto said at least one hinge.

9. The apparatus to aid in diving techniques set forth in claim 1, further characterized in that said slide assembly further comprises a lip angularly extending a predetermined length from said second end without reaching said first end.

10. The apparatus to aid in diving techniques set forth in claim 1, further characterized in that said slide assembly further comprises at least transversal support member positioned between said first and second lateral sides.

11. An apparatus to aid in diving techniques, comprising:

A) a base assembly comprising first and second frame arms that are kept in a parallel and spaced apart relationship with respect to first and second transversal supports, said first and second frame arms are perpendicularly disposed to said first and second transversal supports, said first and second frame arms each have a plurality of through holes, said first transversal support comprises a first L-bracket and said second transversal support comprises a second L-bracket;

B) a slide assembly comprising a top face having first and second lateral sides extending therefrom and first and second ends, said first and second lateral sides each have lateral edges, said slide assembly further comprising a bottom face having longitudinal frame members that are kept at a spaced apart relationship with respect to each other by third transversal supports, said longitudinal frame members extend beyond said first end, and said longitudinal frame members of said slide assembly hingedly mounted onto said base assembly by at least one hinge; and C) elevation means to elevate said first end to place said slide assembly from an approximately horizontal position to an angled position.

12. The apparatus to aid in diving techniques set forth in claim 11, further characterized in that said first L-bracket and said second L-bracket face each other so as to form a U-shape with said first and second frame arms.

13. The apparatus to aid in diving techniques set forth in claim 12, further characterized in that said first transversal support is fixed onto said first and second frame arms.

14. The apparatus to aid in diving techniques set forth in claim 13, further characterized in that said second transversal support comprises first and second journaling sleeves to journal said first and second frame arms.

15. The apparatus to aid in diving techniques set forth in claim 14, further characterized in that said longitudinal frame members each have third and fourth ends.

16. The apparatus to aid in diving techniques set forth in claim 15, further characterized in that said fourth end of said at least one longitudinal frame member fits onto a receiving member secured onto said at least one hinge.

17. The apparatus to aid in diving techniques set forth in claim 11, further characterized in that said slide assembly further comprises a lip angularly extending a predetermined length from said second end without reaching said first end.

18. The apparatus to aid in diving techniques set forth in claim 17, further characterized in that said slide assembly further comprises at least transversal support member positioned between said first and second lateral sides.

* * * * *